US005419646A

United States Patent [19]

Taylor

[11] Patent Number: 5,419,646

[45] Date of Patent: May 30, 1995

[54] LOTION APPLICATOR WITH HINGED EXTENSION ARMS AND ROLLER

[76] Inventor: Bo Taylor, 1509 Alabama St., Gadsden, Ala. 35901

[21] Appl. No.: 214,576

[22] Filed: Mar. 18, 1994

[51] Int. Cl.[6] ..... A45D 34/04; A45D 34/00

[52] U.S. Cl. ..... 401/21; 401/22; 401/140; 401/207; 401/220

[58] Field of Search ..... 401/21, 22, 23, 140, 401/205, 207, 220; 15/144.1

[56] References Cited

U.S. PATENT DOCUMENTS

| | | | |
|---|---|---|---|
| 1,021,708 | 3/1912 | Schaeneman | 401/205 |
| 1,518,320 | 12/1924 | Gates | 401/22 |
| 1,545,392 | 7/1925 | Brown | 401/205 X |
| 2,187,670 | 1/1940 | Suddarth | 401/205 |
| 2,469,050 | 5/1949 | Mygas | 15/144.1 |
| 2,537,784 | 1/1951 | Nord | 401/205 |
| 2,829,393 | 4/1958 | Turcotte | 401/207 |
| 2,837,756 | 6/1958 | Barlow et al. | 401/22 |

FOREIGN PATENT DOCUMENTS

| | | | |
|---|---|---|---|
| 86927 | 11/1895 | Germany | 401/140 |
| 541861 | 4/1956 | Italy | 401/21 |
| 96304 | 5/1960 | Norway | 401/205 |

*Primary Examiner*—Steven A. Bratlie

[57] ABSTRACT

A lotion applicator with a hinged extension arm includes an upper extension arm formed as an elongated cylindrical member with an upper region and a lower region. The lowermost extent of the lower region includes a coupling device for attachment thereto. A lower extension arm is formed as an elongated cylindrical member having an upper region and a lower region. The uppermost extent of the upper region includes a coupling device for attachment thereto. The lowermost extent of the lower region is formed in an L-shaped configuration. A coupling screw is adapted to couple the upper extension arm to the lower extension arm at their respective coupling devices. An open cell foam sponge is shaped in a generally planar, oval configuration with an upper surface and a lower surface. The sponge includes a middle section with a small thickness and rounded ends with a large thickness. A sponge coupling mechanism joins the lowermost extent of the lower extension arm to the upper surface of the sponge. The mechanism includes an aperture for the introduction of liquid into the sponge.

1 Claim, 4 Drawing Sheets

LOTION APPLICATOR WITH HINGED EXTENSION ARMS AND ROLLER

BACKGROUND OF THE INVENTION

1. Field of the Invention

The present invention relates to lotion applicators with hinged extension arms and more particularly pertains to dispensing controlled amounts of lotion on difficult to reach areas of the user's body.

2. Description of the Prior Art

The use of lotion applicators is known in the prior art. More specifically, lotion applicators heretofore devised and utilized for the purpose of dispensing controlled amounts of lotion on the user's body are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,475,837 to Dornbusch et al., a roll-on applicating package with sealing cap.

U.S. Pat. No. 4,342,522 to Mackles discloses a roll-on dispenser with a flexible membrane.

U.S. Pat. No. 4,021,125 to Berghahn et al. discloses a ball roll-on dispenser.

U.S. Pat. No. 5,180,242 to De Laforcade discloses a roll-on application with frangible cap.

Lastly, U.S. Pat. Des. No. 290,527 to Thorogood discloses the ornamental design for a roll-on applicator.

In this respect, the lotion applicators with hinged extension arms according to the present invention substantially departs from the conventional concepts and designs of the prior art, and in doing so provides an apparatus primarily developed for the purpose of dispensing controlled amounts of lotion on difficult to reach areas of the user's body.

Therefore, it can be appreciated that there exists a continuing need for new and improved lotion applicators with hinged extension arms which can be used for dispensing controlled amounts of lotion on difficult to reach areas of the user's body. In this regard, the present invention substantially fulfills this need.

SUMMARY OF THE INVENTION

In view of the foregoing disadvantages inherent in the known types of lotion applicators now present in the prior art, the present invention provides improved lotion applicators with hinged extension arms. As such, the general purpose of the present invention, which will be described subsequently in greater detail, is to provide new and improved lotion applicators with hinged extension arms and method which has all the advantages of the prior art and none of the disadvantages.

To attain this, the present invention essentially comprises a new and improved lotion applicator with a hinged extension arm including an upper extension arm formed as an elongated cylindrical member with an upper region and a lower region. The upper region includes a rounded end at its uppermost extent with a plurality of circumferential grooves proximate to the rounded end. The lowermost extent of the lower region is formed as a circular member with a larger radius than the cylindrical member. The circular member also includes a centrally located circular aperture with a plurality of internal screw threads. A lower extension arm is formed as a hollow elongated cylindrical member having an upper region and a lower region. The uppermost extent of the upper region is formed as a circular member with a larger radius than the cylindrical member. The circular member includes a centrally located circular aperture, and a keeper ring embedded within its central core. The upper region also includes a circular hole with internal screw threads located a short distance below the circular member. The lower extension arm includes a filler plug having a planar circular upper portion contiguous with a shaft portion and external screw threads throughout its extent. The filler plug is removably positioned in the hole in the upper region to permit filling of the hollow interior with fluid. The lower region is formed in an L-shaped configuration and includes an open end at its lowermost extent. The lower region also includes a control valve located a short distance above the L-shaped portion. The control valve has a planar circular portion positioned within the hollow lower extension arm and a contiguous knob portion which extends through the extension arm. The control valve is adapted to allow the user to regulate the flow of fluid by turning the valve to various open positions. A pivoting hinge screw is adapted to couple the upper extension arm to the lower extension arm at their respective circular members so as to allow pivoting of the arms. The screw consists of a head section and a shaft section. The head section is formed in a planar circular configuration. The shaft section is formed in a cylindrical configuration with an upper portion and a lower portion. The upper portion has a smooth outer surface and is joined to the center of the head section at its uppermost extent. The lower portion measures approximately the same length as the upper portion of the shaft section and includes a plurality of external screw threads throughout its extent. An open cell foam sponge is shaped in a generally planar oval configuration. The sponge has a middle section with long sides and a small thickness, and rounded ends with a large thickness. The middle section includes a flat upper surface and a flat lower surface. A sponge holder is shaped in a generally planar rectangular configuration with an upper surface and a lower surface. The holder also includes a centrally located circular aperture. The upper surface of the holder is affixed to the lowermost extent of the lower extension arm. The circular aperture is positioned in alignment with the hollow interior of the lower extension arm to allow the free flow of fluid through the sponge holder and into the sponge. The sponge holder is adapted to permit the sponge to be affixed to the upper and lower surfaces of the holder.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide new and improved lotion applicators with hinged extension arms which have all the advantages of the prior art lotion applicators and none of the disadvantages.

It is another object of the present invention to provide new and improved lotion applicators with hinged extension arms which may be easily and efficiently manufactured and marketed.

It is further object of the present invention to provide new and improved lotion applicators with hinged extension arms which are of durable and reliable constructions.

An even further object of the present invention is to provide new and improved lotion applicators with hinged extension arms which are susceptible of a low cost of manufacture with regard to both materials and labor, and which accordingly are then susceptible of low prices of sale to the consuming public, thereby making such lotion applicators with hinged extension arms economically available to the buying public.

Still yet another object of the present invention is to provide new and improved lotion applicators with hinged extension arms which provide in the apparatuses and methods of the prior art some of the advantages thereof, while simultaneously overcoming some of the disadvantages normally associated therewith.

Still another object of the present invention is to dispense controlled amounts of lotion on difficult to reach areas of the user's body.

Lastly, it is an object of the present invention to provide new and improved lotion applicators with hinged extension arms which include an upper extension arm formed as an elongated cylindrical member with an upper region and a lower region. The lowermost extent of the lower region includes a coupling device for attachment thereto. A lower extension arm is formed as an elongated cylindrical member having an upper region and a lower region. The uppermost extent of the upper region includes a coupling device for attachment thereto. The lowermost extent of the lower region is formed in an L-shaped configuration. A coupling screw is adapted to couple the upper extension arm to the lower extension arm at their respective coupling devices. An open cell foam sponge is shaped in a generally planar, oval configuration with an upper surface and a lower surface. The sponge includes a middle section with a small thickness and rounded ends with a large thickness. A sponge coupling mechanism joins the lowermost extent of the lower extension arm to the upper surface of the sponge. The mechanism includes an aperture for the introduction of liquid into the sponge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
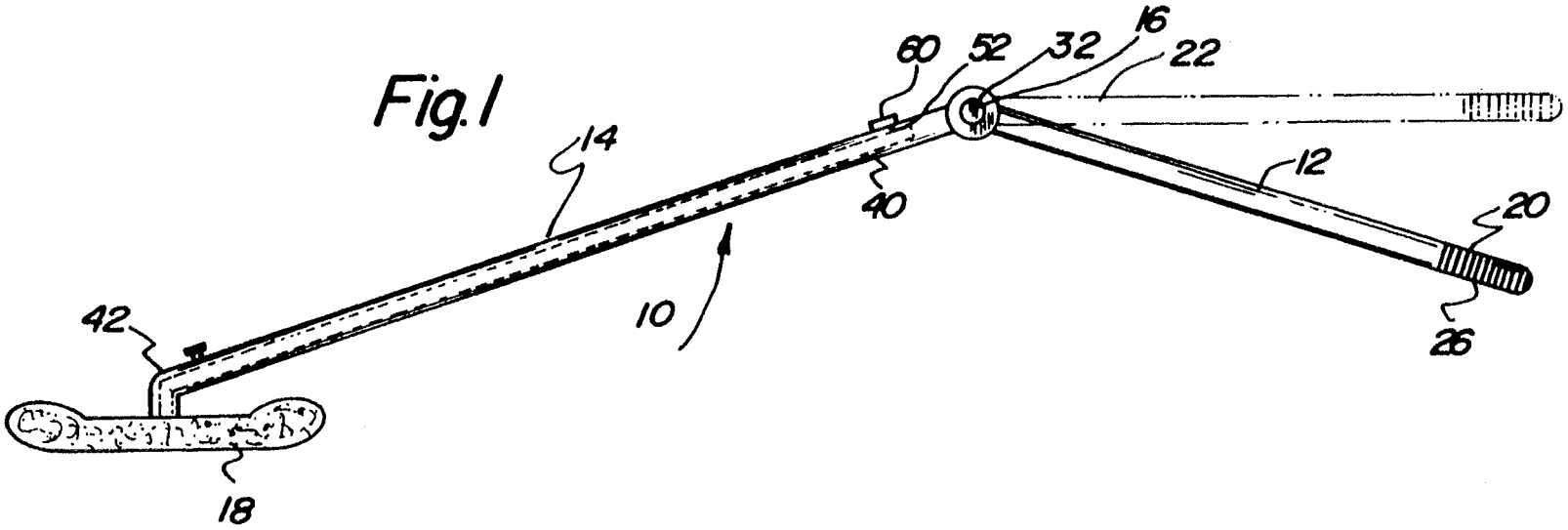
FIG. 1 is a perspective view of the preferred embodiment of the lotion applicators with hinged extension arms constructed in accordance with the principles of the present invention.
Figure 2:
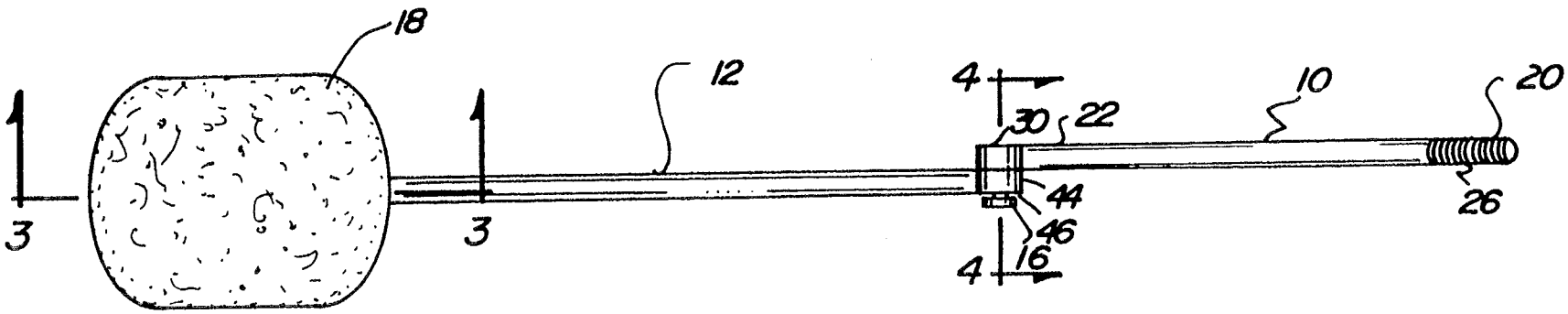
FIG. 2 is a bottom plan view of the lotion applicator shown in FIG. 1.
Figure 4:
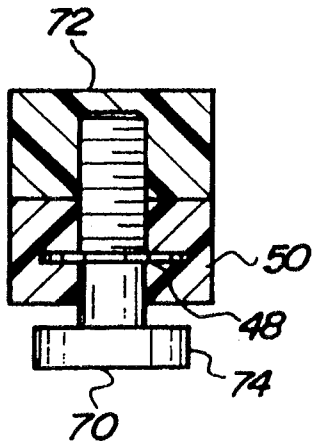
FIG. 4 is a cross sectional view taken along line 4—4 of FIG. 2.
Figure 3:
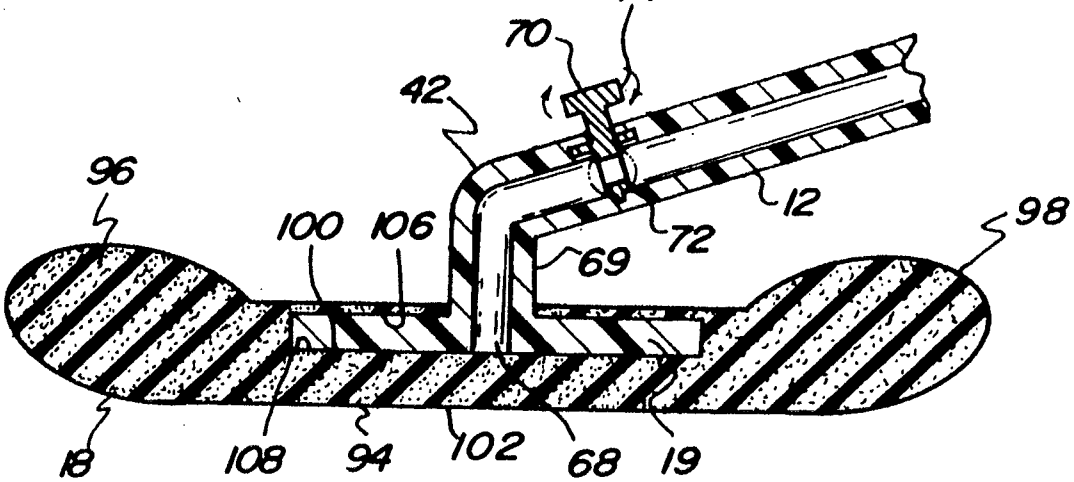
FIG. 3 is a cross sectional view taken along line 3—3 of FIG. 2.
Figure 5:
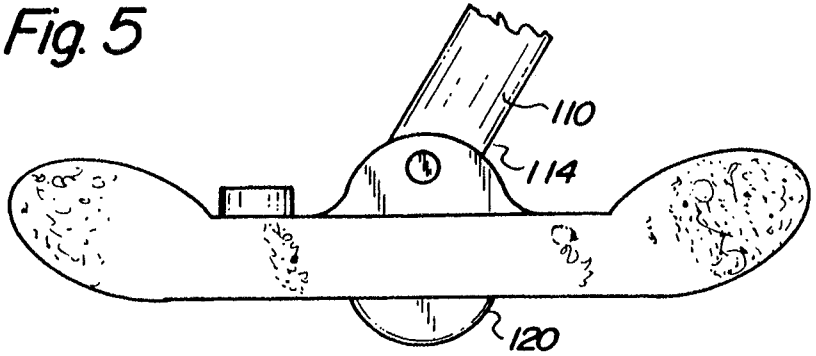
FIG. 5 is a broken away, side plan view of the open cell foam sponge and surrounding components of an alternative embodiment of the lotion applicator.
Figure 6:
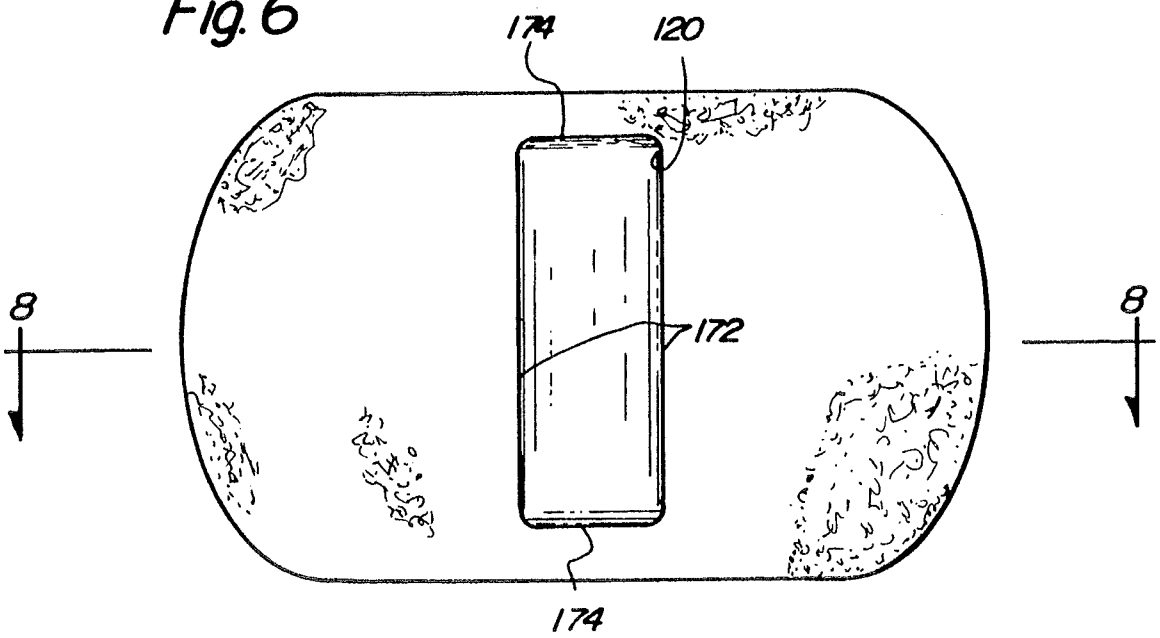
FIG. 6 is a bottom plan view of the alternative embodiment of the lotion applicator shown in FIG. 5.
Figure 7:
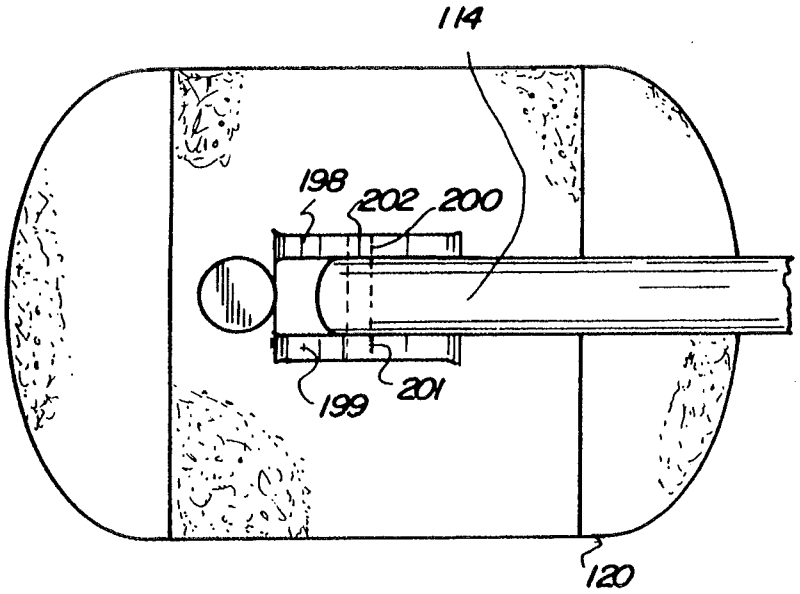
FIG. 7 is a top plan view of the alternative embodiment of the lotion applicator shown in FIG. 5.
Figure 8:
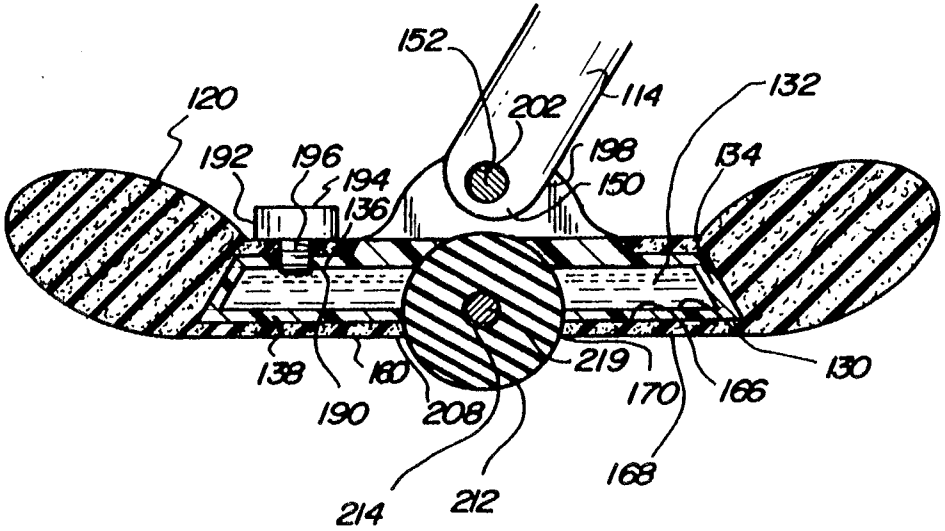
FIG. 8 is a cross sectional view of the alternative embodiment of the lotion applicator take along line 8—8 of FIG. 6.

With reference now to the drawings, and in particular to FIG. 1 thereof, the preferred embodiment of the new and improved lotion applicators with hinged extension arms embodying the principles and concepts of the present invention and generally designated by the reference numeral 10 will be described.

Specifically, it will be noted in FIGS. 1 through 4 that there is provided a new and improved lotion applicator with a hinged extension arm 10. The lotion applicator 10, in its broadest context, comprises an upper extension arm 12, a lower extension arm 14, a pivoting hinge screw 16, an open cell foam sponge 18 and a rigid sponge holder 19.

More specifically, the upper extension arm 12 is formed as an elongated cylindrical member with an upper region 20 and a lower region 22. The upper region 20 includes a rounded end at its uppermost extent with a plurality of circumferential grooves 26 proximate to the rounded end. The lowermost extent of the lower region 22 is formed as a circular member 30 with a larger radius than the cylindrical member. The circular member 30 also includes a centrally located circular aperture 32 with a plurality of internal screw threads.

A lower extension arm 14 is formed as a hollow elongated cylindrical member having an upper region 40 and a lower region 42. The uppermost extent of the upper region 40 is formed as a circular member 44 with a larger radius than the cylindrical member. The circular member 44 includes a centrally located circular aperture 46, and a keeper ring 48 embedded within its central core 50. The upper region 40 also includes a circular hole 52 with internal screw threads located a short distance below the circular member 44. The lower extension arm 14 includes a filler plug 60 having a planar circular upper portion contiguous with a shaft portion and external screw threads throughout its extent. The filler plug 60 is removably positioned in the hole 52 in the upper region to permit filling of the hollow interior with fluid.

The lower region 42 of the lower extension arm is formed in an L-shaped configuration 69 and includes an open end 68 at its lowermost extent. The lower region 42 also includes a control valve 70 located a short distance above the L-shaped portion 69. The control valve 70 has a planar circular portion 72 positioned within the hollow lower extension arm 14 and a contiguous knob portion 74 which extends through the extension arm 14. The control valve 70 is adapted to allow the user to regulate the flow of fluid by turning the valve 70 to various open positions.

A pivoting hinge screw 16 is adapted to couple the upper extension arm 12 to the lower extension arm 14 at their respective circular members 30, 44 so as to allow pivoting of the arms. The screw consists of a head section and a shaft section. The head section is formed in a planar circular configuration. The shaft section is formed in a cylindrical configuration with an upper portion and a lower portion. The upper portion has a smooth outer surface and is joined to the center of the head section at its uppermost extent. The lower portion measures approximately the same length as the upper portion of the shaft section and includes a plurality of external screw threads throughout its extent.

An open cell foam sponge 18 is shaped in a generally planar oval configuration. The sponge has a middle section 94 with long sides and a small thickness, and rounded ends 96, 98 with a large thickness. The middle section 94 includes a flat upper surface 100 and a flat lower surface 102.

A sponge holder 19 is shaped in a generally planar rectangular configuration with an upper surface 106 and a lower surface 108. The holder 19 also includes a centrally located circular aperture 68. The upper surface 106 of the holder is affixed to the lowermost extent of the lower extension arm 14. The circular aperture 68 is positioned co-extensive with the hollow interior of the lower extension arm 14 to allow the free flow of fluid through the sponge holder 19 and into the sponge 18. The sponge holder 19 is adapted to permit the sponge 18 to be affixed to the upper 106 and lower 108 surfaces of the holder 19.

An alternative embodiment of the lotion applicator with a hinged extension arm, in its broadest context, comprises an upper extension arm, a lower extension arm 110, a pivoting hinge screw, an open cell foam sponge with an aperture 120, and a hollow dispensing tank 130.

More specifically, the upper extension arm is formed as an elongated cylindrical member with an upper region and a lower region. The upper region includes a rounded end at its uppermost extent with a plurality of circumferential grooves proximate to the rounded end. The lowermost extent of the lower region is formed as a circular member 30 with a larger radius than the cylindrical member. The circular member also includes a centrally located circular aperture with a plurality of internal screw threads.

A lower extension arm 110 is formed as an elongated cylindrical member having an upper region and a lower region 114. The uppermost extent of the upper region is formed as a circular member 116 with a larger radius than the cylindrical member. The circular member includes a centrally located circular aperture 118, and a keeper ring embedded within its central core. The lower region is formed to include a rounded end 150 at its lowermost extent with a centrally located circular aperture 152 extending therethrough.

A pivoting hinge screw is adapted to couple the upper extension arm to the lower extension arm at their respective circular members so as to allow pivoting of the arms. The screw consists of a head section and a shaft section. The head section is formed in a planar circular configuration. The shaft section is formed in a cylindrical configuration with an upper portion and a lower portion. The upper portion has a smooth outer surface and is joined to the center of the head section at its uppermost extent. The lower portion measures approximately the same length as the upper portion of the shaft section and includes a plurality of external screw threads throughout its extent.

An open cell foam sponge 120 is shaped in a generally planar oval configuration. The sponge has a middle section 160 with long sides and a small thickness, and rounded ends 162,164 with a large thickness. The middle section 160 includes a flat upper surface 166 and a flat lower surface 168. The sponge also includes a centrally located generally rectangular shaped slot 170 with parallel long sides 172 and parallel short sides 174. The long sides 172 of the slot 170 are positioned in a generally parallel orientation with respect to the long sides of the middle section 160.

A hollow dispensing tank or reservoir 130 is formed as a generally rectangular shaped box with long horizontal side plates 132, short vertical side plates 134, a horizontal roof plate 136, and a horizontal floor plate 138. The tank has slightly slanted vertical sides 134. All of the plates have an internal surface and an external surface. A small aperture 190 with internal screw threads is positioned through the roof 136. A filler cap 192 has a planar circular upper portion 194 contiguous with a shaft portion 196 and includes external screw threads throughout its extent. The filler cap 192 is positioned in the aperture 190 in the roof of the tank.

The roof 136 also has a pair of upwardly extending, generally semicircular shaped brackets 198, 199 emanating from the central portion of the external surface of the roof 136. The brackets 198, 199 are positioned in parallel orientation to each other with a small space therebetween. Each includes a circular hole 200, 201 near its rounded upper extent. The brackets 198, 199 also include a pivoting screw 202 to permit releasable coupling of the brackets to the lower end of the lower extension arm 110. The internal surfaces of the tank define the boundaries of the reservoir 130 for the containment of fluid. The floor 138 of the tank includes a centrally located, generally rectangular aperture 208 with a centrally located thin cylindrical rod 210 extending from one vertical side wall to the opposite side. A rubber roller 212 is formed as a cylinder with an aperture 214 extending through its axis. The length of the roller 212 is slightly smaller than the length of the slot 170 in the sponge so that it may depend through the aperture 208 in the floor and slot 170 in the sponge when in the operative orientation. The roller 212 is adapted to dispense controlled quantities of the contents of the tank when rotated. The roller 212 is positioned in the aperture 208 of the floor of the tank resting on the cylindrical rod 210 so that it may rotate thereabout. The hollow dispensing tank 130 is adapted to permit the sponge 120 to be affixed to the external surfaces of the floor and sides of the tank.

The lotion applicator with a hinged extension arm was developed to enable the user to apply lotion to parts of the body which are difficult or impossible to reach. To utilize the apparatus the user simply removes the filler cap and fills with the desired fluid. The filler cap is tightly coupled to the coupling means on the aperture to keep out dirt and sand. The apparatus is particularly useful for applying sun tan lotion to a user's back. The hinged extension arms permit the user to apply lotion to their body from a wide variety of different positions.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved applicator with a hinged extension arm for dispensing controlled amounts of lotion on difficult to reach areas of a user's body comprising, in combination:

an upper extension arm formed as an elongated cylindrical member with an upper region and a lower region, the upper region including a rounded end at its uppermost extent with a plurality of circumferential grooves proximate to the rounded end, the lowermost extent of the lower region being formed as a circular member with a larger radius than the cylindrical member, the circular member also including a centrally located circular aperture with a plurality of internal screw threads;

a lower extension arm formed as an elongated cylindrical member having an upper region and a lower region, the uppermost extent of the upper region being formed as a circular member with a larger radius than the cylindrical member, the circular member including a centrally located circular aperture and a keeper ring embedded within its central core, with the lower region being formed in an L-shaped configuration and including a rounded end at its lowermost extent with a centrally located circular aperture extending therethrough;

a pivoting hinge screw adapted to couple the upper extension arm to the lower extension arm at their respective circular members so as to allow pivoting of the arms, the screw consisting of a head section, and a shaft section, the head section being formed in a planar circular configuration, the shaft section being formed in a cylindrical configuration, the shaft section being formed in a cylindrical configuration with an upper portion and a lower portion, the upper portion having a smooth outer surface and joined to the center of the head section at its uppermost extent, the lower portion measuring approximately the same length as the upper portion of the shaft section and including a plurality of external screw threads throughout its extent;

an open cell foam sponge, the sponge shaped in a generally planar oval configuration with a middle section having long sides and a small thickness and rounded ends having an enlarged thickness, the middle section having a flat upper surface and a flat lower surface, the sponge including a centrally located, generally rectangular shaped slot with parallel long sides and parallel short sides, with the long sides of the slot positioned in a generally perpendicular orientation with respect to the long sides of the middle section; and a hollow dispensing tank formed as a generally rectangular shaped box with long horizontal side plates and short vertical side plates, a horizontal roof plate, a horizontal floor plate, and slightly slanted vertical sides, all plates having an internal surface and an external surface, the tank having a small aperture with internal screw threads positioned through the roof, and a filler cap having a planar circular upper portion contiguous with a shaft portion and including external screw threads throughout its extent, the filler cap being positioned in the aperture in the roof of the tank, the roof also having a pair of upwardly extending generally semicircular shaped brackets emanating from the central portion of the external surface of the roof, the brackets being positioned in parallel orientation to each other with a small space therebetween and each including a circular hole near its rounded upper extent, the brackets also including a pivoting screw to permit releasable coupling of the brackets to the lower end of the lower extension arm, with the internal surfaces of the tank defining the boundaries of a reservoir for the containment of fluid, with the floor of the tank including a centrally located, generally rectangular aperture with a centrally located thin cylindrical bar extending from one vertical side wall to the opposite side, and a rubber roller formed as a cylinder with an aperture extending through its axis, the length of the roller being slightly smaller than the length of the slot in the sponge so that it may depend through the aperture in the floor and slot in the sponge when in the operative orientation, the roller being adapted to dispense controlled quantities of the contents of the tank when rotated, the roller being positioned in the aperture of the floor of the tank resting on the cylindrical bar so that it may rotate thereabout, with the roll-on dispensing system being adapted to permit the sponge to be affixed to the external surfaces of the floor and sides of the tank.

* * * * *